US005341607A

United States Patent [19]

Perneczky

[11] Patent Number: 5,341,607

[45] Date of Patent: Aug. 30, 1994

[54] METHOD AND APPARATUS FOR POLISHING HOT STRIP MILL RUN-OUT TABLE ROLLS

[76] Inventor: George C. Perneczky, 8918 Biloba, Orland Park, Ill. 60462

[21] Appl. No.: 1,453

[22] Filed: Jan. 7, 1993

[51] Int. Cl.[5] ..... B24D 11/00

[52] U.S. Cl. ..... 51/289 R; 51/281 R; 51/328; 51/395; 51/397; 51/154

[58] Field of Search ..... 51/149, 150, 154, 395, 51/396, 397, 211 R, 251, 289 R, 287 R, 326, 327, 328, 135 R, 137, 139, 144

[56] References Cited

U.S. PATENT DOCUMENTS 4,571,893 2/1986 Braasch ..... 51/397

*Primary Examiner*—Bruce M. Kisliuk
*Assistant Examiner*—Eileen Morgan
*Attorney, Agent, or Firm*—Keck, Mahin & Cate

[57] ABSTRACT

The invention relates to an apparatus and method for polishing run-out table rolls. The apparatus includes a polishing block assembly having linked abrasive blocks and a positioning apparatus to position the blocks in contact with the surface of the run-out table rolls that are to be polished. The method includes the steps of positioning the assembly over the rolls, lowering the assembly into contact with the rolls, transporting the assembly in a linear direction over the rolls to effect the polishing and thereafter removing the assembly from the rolls.

29 Claims, 6 Drawing Sheets

METHOD AND APPARATUS FOR POLISHING HOT STRIP MILL RUN-OUT TABLE ROLLS

BACKGROUND OF THE INVENTION

1. Field of the Invention

The present invention relates to industrial cleaning and polishing technology, and particularly to an apparatus and process for polishing hot strip mill run-out table rolls to remove iron deposits from the rolls.

2. Description of the Prior Art

Modern integrated steel mills include a hot strip mill for processing preheated steel slabs into coils. To form steel coils, steel slabs are first introduced into slab preheating furnaces located at one end of the hot strip mill. The resulting preheated slabs then travel over a large number of table rolls in the direction of a scale breaker, after which the slabs travel through either a reversing rougher mill or several continuous roughing mills.

The roughing mills typically reduce the thickness of the slabs from 8" to 10" to ¾" to 1",producing "hot strips" of steel. The hot strips then travel toward a series of finishing stands. A hot strip mill usually includes five to seven finishing stands, each finishing stand consisting of two work rolls and two back-up rolls. The work rolls in a finishing stand must be frequently replaced (two to three times in an eight hour shift), due to the rapid roll surface deterioration which occurs during rolling. The finishing stands further reduce the thickness of the hot strips. The last finishing stand does not significantly reduce the thickness of the hot strips, but establishes the final shape of the surface of the hot strips. At this stage in the processing, the hot strips remain in a plasticized state.

Between the last finishing stand and the downcoiler, where the hot strips are formed into coils, there are approximately 300 to 500 run-out table rolls. The hot strips are transported by the run-out table rolls at high speed (40 to 60 miles per hour) in the direction of downcoiler pinch rolls. The downcoiler pinch rolls grab the hot strips, and direct the leading nose of the hot strips toward a coil-making apparatus. Substantial tension is developed between the downcoiler pinch rolls and the coiler to assure the making of tight coils. While the hot strips are traveling over the numerous run-out table rolls, the hot strips are cooled by water sprayed onto the hot strips from above and below.

Since the plasticized hot strips travel over the run-out table rolls at relatively high speeds, iron deposits tend to build up on the surface of the run-out table rolls. The iron deposits often mark up the surface of the hot strips to such an extent that the hot strips cannot be used to manufacture consumer goods.

To remedy this problem, hot strip mills are periodically shut down so that the several hundred run-out table rolls can be hand-ground to clean off the accumulated iron deposits. Hand-grinding poses a significant danger to laborers, however, because the run-out table rolls must be motor-driven while the hand-grinding process is carried out. Moreover, hand-grinding is a time-consuming task which results in an unrecoverable loss of eight to sixteen hours of production every time the mill must be shut-down to clean the run-out table rolls.

Modern hot strip mills are capable of producing three to five million tons of steel coils per annum at a cost of several hundred dollars per ton of steel. However, the poor quality of the manufactured coils resulting from damage caused by iron deposits on the table rolls, and the loss of productivity associated with periodic hand-grinding of the rolls, presently cost hot strip mills tens of millions of dollars per year.

In this regard, a number of hot strip mills have been permanently closed over the past two decades due to lost productivity and the inability of the mills to meet quality demands placed on them by the automobile and other industries. The annual world-wide production of hot-rolled steel coils has in fact been substantially reduced, resulting in a shortage of hot-rolled coils that is projected to continue into the future.

Domestically, a number of hot strip mills have been modernized at a cost of 200 to 300 million dollars each. The projected cost for a new, state-of-the-art hot strip mill is between 500 million and one billion dollars. It can take five to seven years to complete the construction of a new mill. In view of these costs, there are presently no known plans to build a new hot strip mill anywhere in the world. Accordingly, substantial demands have been placed on existing hot strip mills to reach their maximum production capacities. Increasing mill productivity by just ½%, for example, would result in millions of dollars in savings per annum.

SUMMARY OF THE INVENTION

Applicant has invented an apparatus and method for polishing run-out table rolls to remove iron deposits from the same. The invention provides hot-rolled coils of improved quality, while eliminating the conventional practice of hand-grinding as well as the need to shut-down a hot mill in order to clean the run-out table rolls.

In particular, an apparatus for polishing run-out table rolls is provided, the apparatus comprising: (a) a polishing block assembly comprising a plurality of linked abrasive blocks; and (b) means for positioning the polishing block assembly over and into contact with a plurality of run-out table rolls.

The invention also provides a method of polishing run-out table rolls, the method comprising: (a) positioning a polishing block assembly over a plurality of run-out table rolls; (b) lowering the polishing block assembly so as to contact the run-out table rolls; (c) transporting the polishing block assembly in a linear direction along the plurality of run-out table rolls, while maintaining contact with the run-out table rolls, so as to polish a surface of the run-out table rolls; and (d) lifting the polishing block assembly off of the run-out table rolls.

A mill crane is preferably utilized to position, lower, transport, and lift the polishing block assembly during the polishing operation. The polishing block assembly (described in detail below) is preferably applied to the run-out table rolls while the rolls are motor-driven at high speed, so as to remove iron deposits which have accumulated on the surface of the run-out table rolls.

Preferably, the table roll polishing operation is carried out during the changing of the work rolls in the finishing stands of the hot mill. As noted above, the work rolls in the finishing stands must be frequently replaced (two to three times in an eight hour shift) due to the rapid deterioration of the work roll surfaces which occurs during processing. The majority of modern hot strip mill finishing stands are outfitted with automatic (robotic) roll-changing apparatus. When the work rolls are changed in the finishing stands, the entire mill is shut down for approximately ten to twelve minutes. Applicant has discovered that the run-out table rolls can be polished during the work roll changing operation, using the apparatus and method provided by the invention. The invention thereby eliminates the need to shut down an entire hot strip mill for the sole purpose of hand-grinding the run-out table rolls.

Polishing run-out table rolls according to the disclosed invention thus improves productivity, eliminates hazardous working conditions, and significantly improves the surface quality of steel coils manufactured in a hot mill.

BRIEF DESCRIPTION OF THE DRAWINGS

In the accompanying drawings, wherein like reference numerals refer to like parts.

DESCRIPTION OF THE PREFERRED EMBODIMENTS

In order to further define the invention, a nonlimiting preferred embodiment of the invention will be described.

Figure 1:
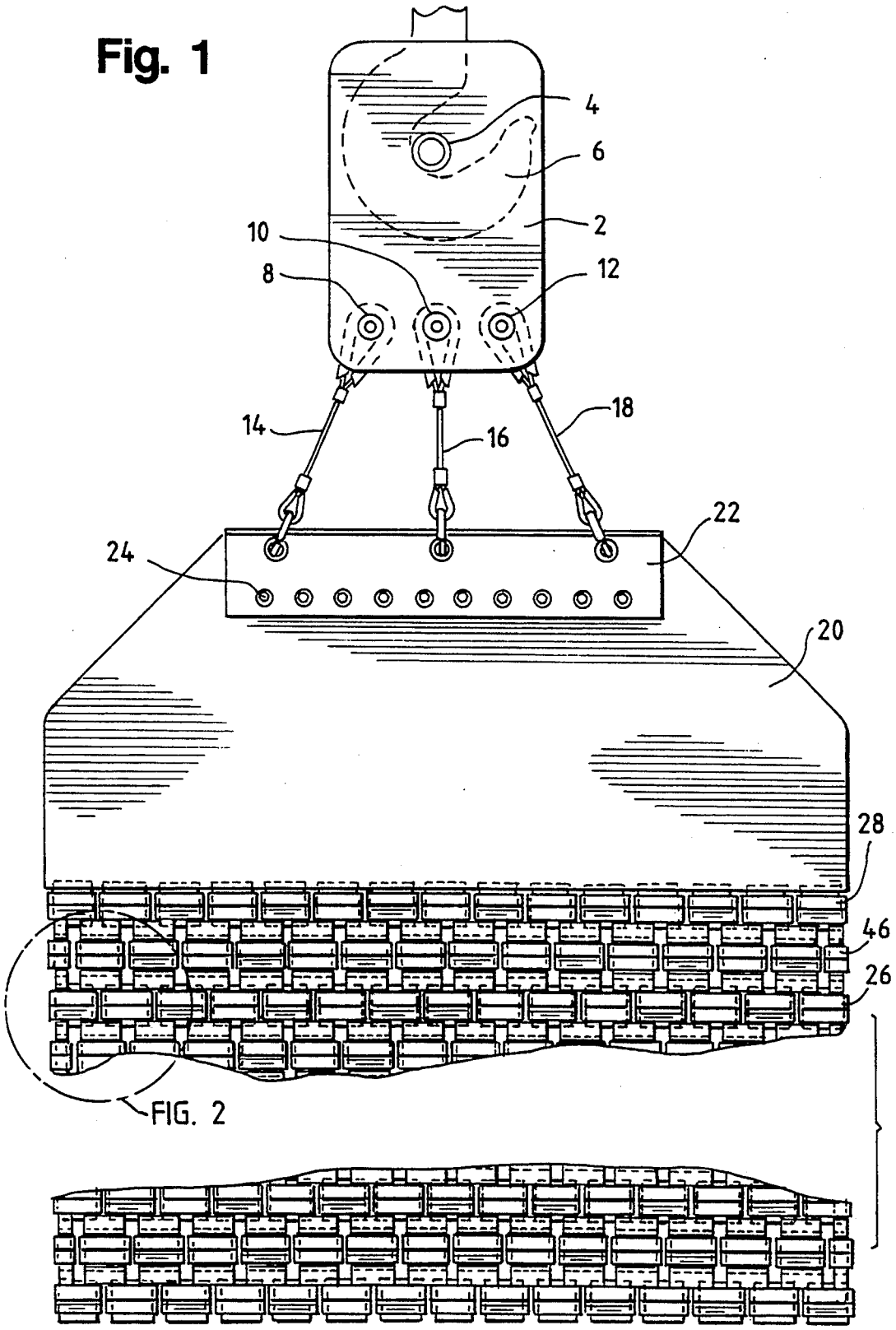
FIG. 1 is a plan view of the apparatus of the invention for polishing run-out table rolls.

Referring to FIG. 1, an apparatus for polishing run-out table rolls as provided by the invention is shown. The apparatus includes a steel block 2 having a heavy-duty pin 4 for engagement with a crane hook 6. The bottom of steel block 2 includes three minor pins (8, 10, 12) supporting three steel cables (14, 16, 18) that are attached to support 20.

Support 20 is a generally flat member formed of suitably strong material such as plastic. The support 20 functions to join polishing block assembly 26 to crane hook 6 via steel block 2 and steel cables (14, 16, 18). Support 20 preferably includes a reinforcing piece 22 constructed of steel or similar material which is fastened over an upper end of support 20 by means of a plurality of hex nuts 24. The lower end of support 20 preferably includes a plurality of holes which permit support 20 to be joined to polishing block assembly 26.

Figure 2:
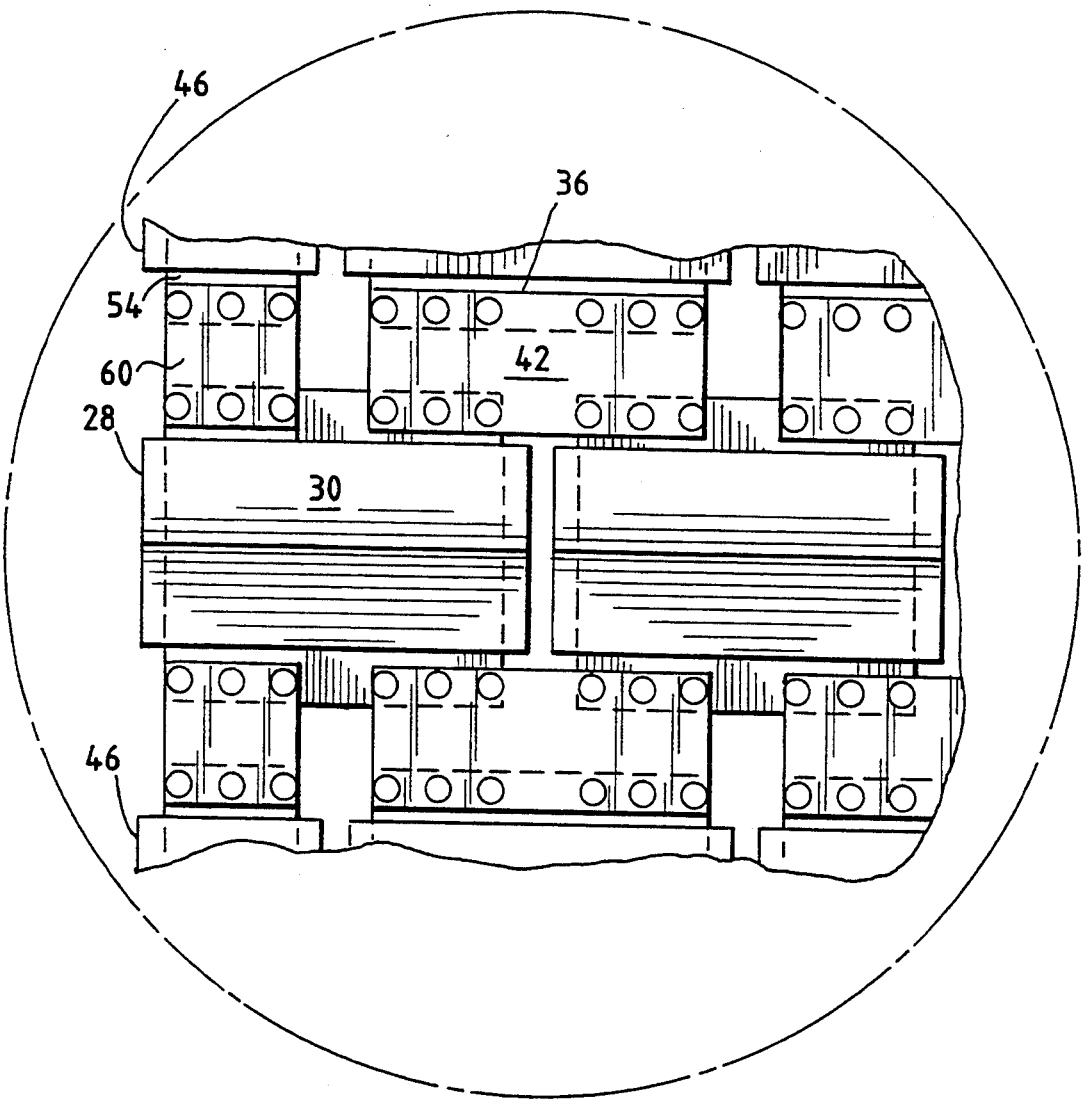
FIG. 2 is an enlarged view of the area circled in FIG. 1, showing details of the polishing block assembly provided by the invention.
Figure 4:
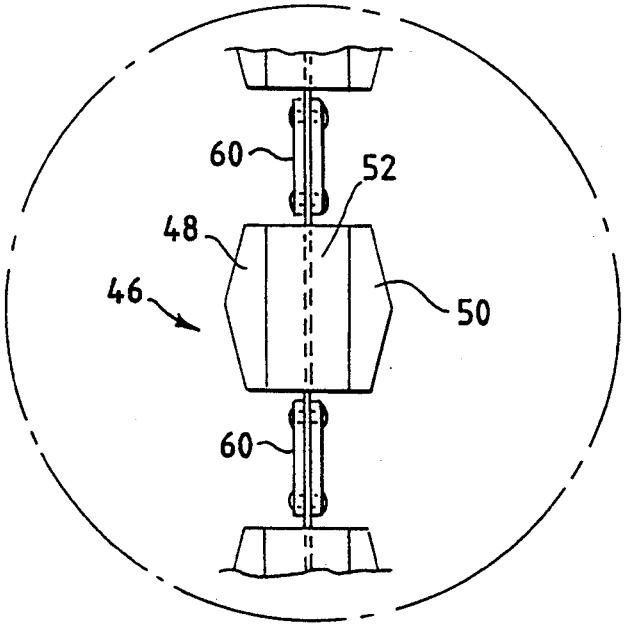
FIG. 4 is an enlarged view of the area circled in FIG. 3, showing a side perspective of an individual abrasive block and the means for connecting the abrasive block to other abrasive blocks.

Polishing block assembly 26 includes a plurality of abrasive blocks (28, 46) linked in a grid-like manner, as best shown in FIGS. 2 and 4. The length of polishing block assembly 26 can be varied depending on the distance available underneath crane hook 6. The width of polishing block assembly 26 can be varied depending on the width of the run-out table rolls in the hot mill.

Figure 3:
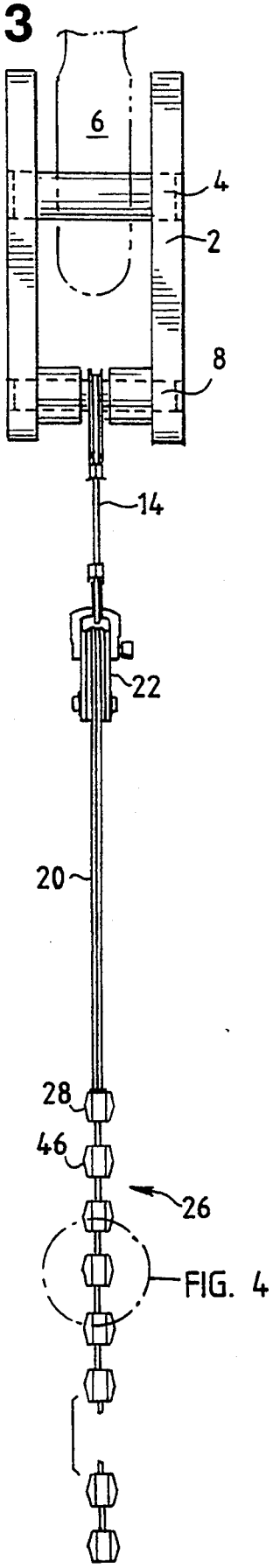
FIG. 3 is a side view of the polishing apparatus of the invention, taken from the left side of FIG. 1.

A side view of the polishing apparatus of the invention, taken from the left side of FIG. 1, is shown in FIG. 3. It can be seen from FIG. 3 that polishing block assembly 26 comprises a plurality of linked abrasive blocks (28, 46). FIG. 4 depicts an enlarged view of the area circled in FIG. 3, showing a side perspective of an individual abrasive block 46 and the means for connecting the abrasive block to other abrasive blocks, as further described below.

Figure 5:
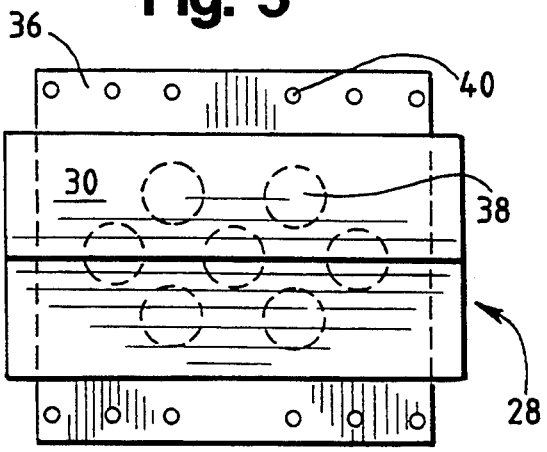
FIG. 5 is a top view of an individual abrasive block, showing in partial cross-section a plate embedded through the abrasive block.
Figure 6:
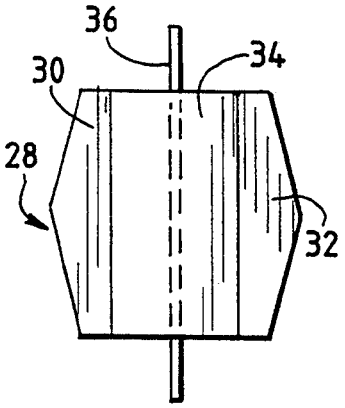
FIG. 6 is a side view of the abrasive block of FIG. 5.
Figure 7:
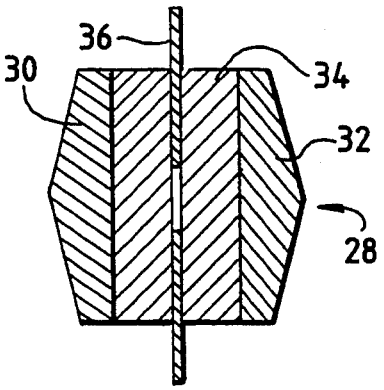
FIG. 7 is a cross-sectional side view of the abrasive block of FIG. 5.

Referring to FIGS. 5–7, individual abrasive blocks 28 include top and bottom contact surface portions (30, 32) formed of a dense and hard material, preferably a hard synthetic rubber having abrasive particles homogeneously embedded therein. Because both the top and bottom contact surface portions (30, 32) are abrasive, the blanket of linked abrasive blocks 28 which make up polishing block assembly 26 can be turned over and either side of polishing block assembly 26 used to polish run-out table rolls.

Figure 15:
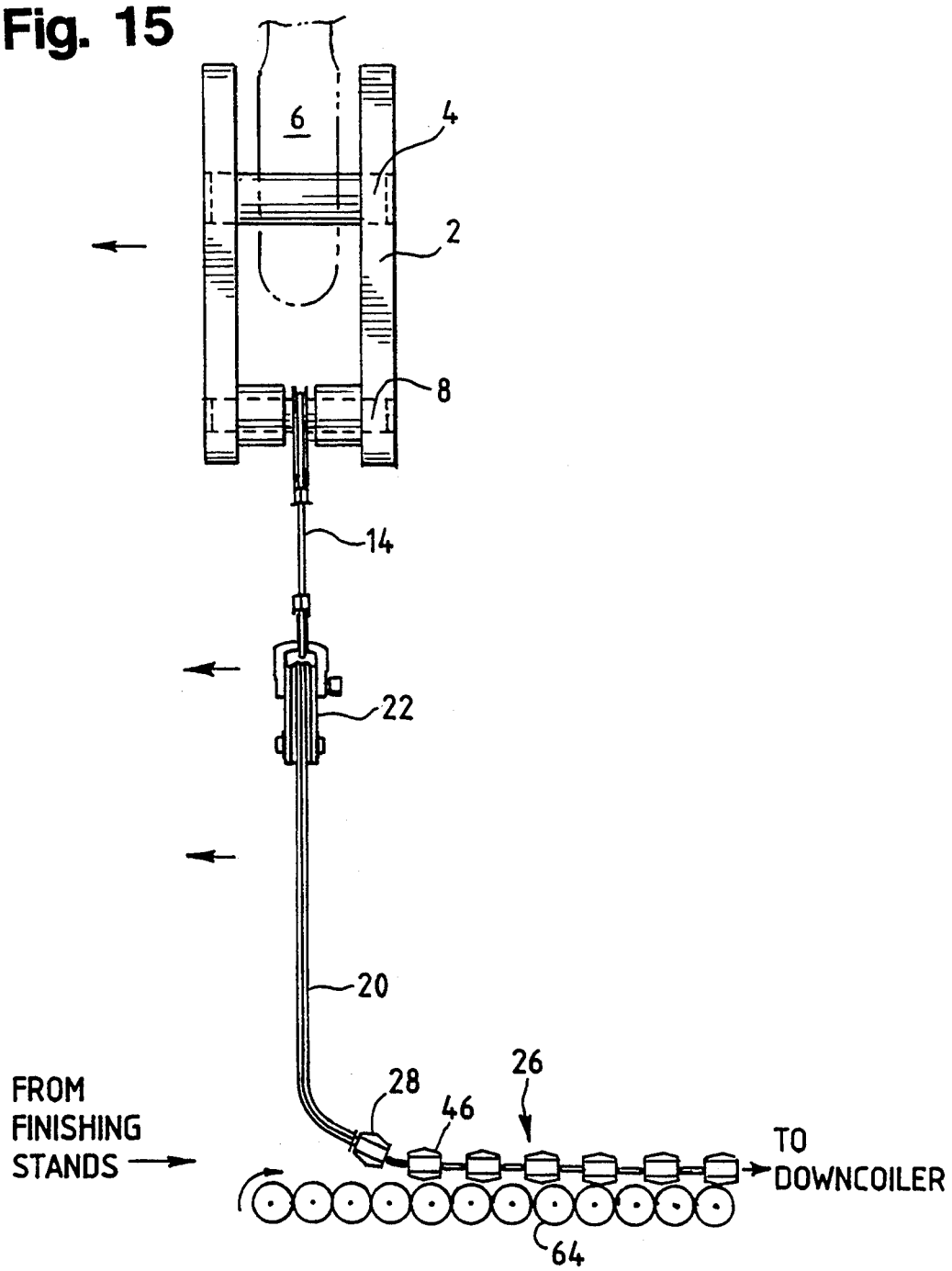
FIG. 15 is a side view showing the apparatus of the invention in operation on a series of run-out table rolls.

Abrasive blocks 28 preferably include a center portion 34 that is constructed of a much softer material than used for contact surface portions (30, 32). Any conventional soft rubber material known in the art may be employed. Forming center portion 34 of abrasive blocks 28 of a softer material enables stainless steel plates 36 embedded within abrasive blocks 28 to flex somewhat during contact between polishing block assembly 26 and the surface of a plurality of aligned run-out table rolls 64, as shown in FIG. 15. Abrasive blocks 28 can be manufactured employing conventional molding technology well-known in the art.

Figure 11:
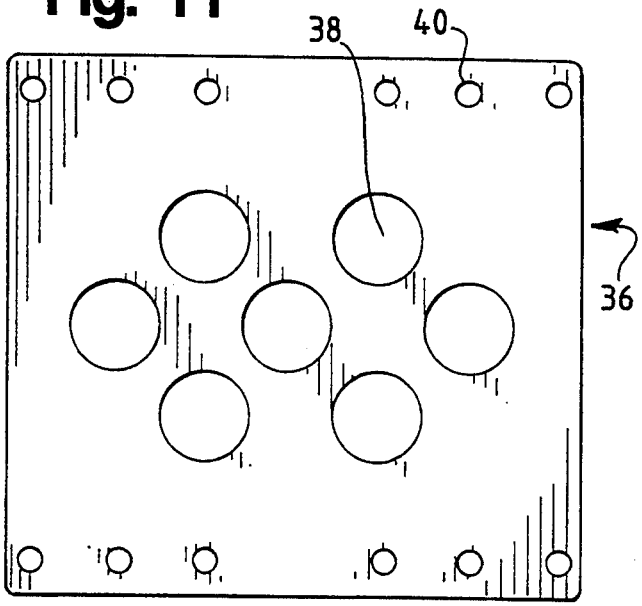
FIG. 11 is a top view of the plate shown in FIGS. 5–7.

As illustrated in FIGS. 5–7, a stainless steel plate 36 is preferably embedded through center portion 34 of each of abrasive blocks 28, such that top and bottom portions of plate 36 extend outside of abrasive blocks 28. As further shown in FIG. 11, steel plate 36 preferably includes a plurality of perforations 38 formed in a central region of the plate so that rubber can be molded around the perforations in a monolithic fashion to enhance mechanical bonding of plate 36 to the center portion 34 of abrasive blocks 28.

Figure 13:
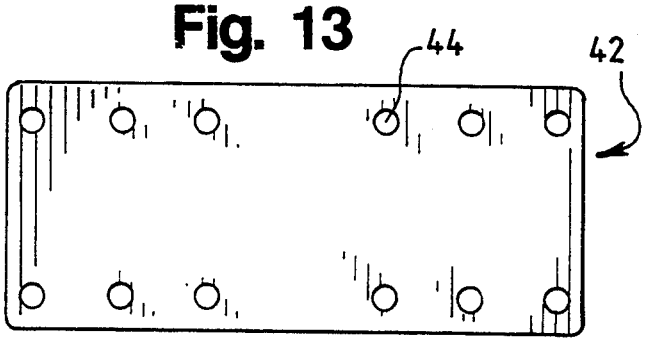
FIG. 13 is a top view of the connecting plate shown in FIG. 1.

Stainless steel plate 36 preferably further includes a plurality of connecting holes 40 which allow abrasive blocks 28 to be linked together. Linkage is preferably achieved by providing a plurality of linking plates 42 (FIG. 13) between adjacent abrasive blocks 28. Linking plates 42 preferably have connecting holes 44 which align with connecting holes 40 in plates 36. Abrasive blocks 28 are thus joined together by riveting rubber linkages (not shown) through connecting holes (40, 44) of plates (36, 42). The rubber linkages provide additional flexibility such that polishing block assembly 26 is sufficiently flexible to accommodate concave table roll shapes or run-out table rolls that are laterally and vertically skewed.

As best shown in FIGS. 1 and 2, abrasive blocks 28 are preferably offset such that each abrasive block 28 located proximate to the central region of polishing block assembly 26 is joined via linking plates 42 to six other abrasive blocks 28. Thus, in order to even out the left and right sides of polishing block assembly 26, half-sized abrasive blocks 46 preferably comprise every other abrasive block along the left and right sides of polishing block assembly 26, as shown in FIGS. 1 and 2.

Figure 8:
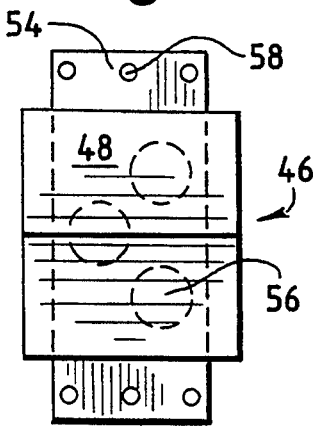
FIG. 8 is a top view of another abrasive block provided by the invention, showing in partial cross-section the plate embedded through the abrasive block.
Figure 9:
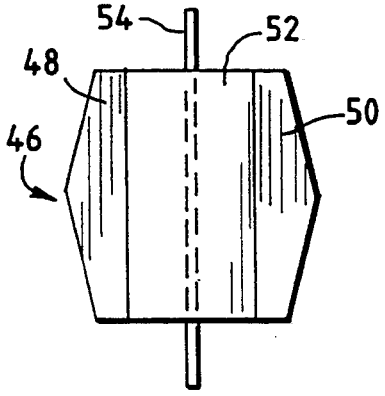
FIG. 9 is a side view of the abrasive block of FIG. 8.
Figure 10:
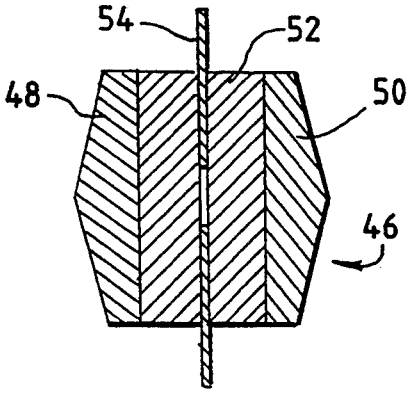
FIG. 10 is a cross-sectional side view of the abrasive block of FIG. 8.
Figure 12:
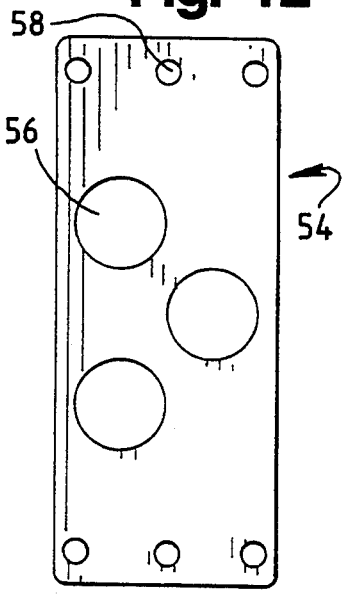
FIG. 12 is a top view of the plate shown in FIGS. 8–10.
Figure 14:
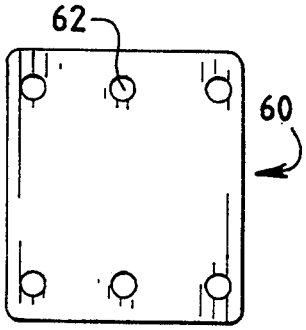
FIG. 14 is a top view of another connecting plate shown in FIG. 1.

Abrasive blocks 46 can be constructed using the same materials and molding techniques described above with regard to abrasive blocks 28. FIGS. 8–10 illustrate that abrasive blocks 46 include top and bottom contact surface portions (48, 52) and middle portions 52, as well as steel plates 54 having perforations 56 and a plurality of connecting holes 58. An individual steel plate 54 is shown in detail in FIG. 12. In addition, half-sized linking plates 60 having connecting holes 62 (FIG. 14) are used to join each abrasive block 46 to surrounding abrasive blocks 28, as best illustrated in FIGS. 2 and 4.

To utilize the above-described apparatus to polish a plurality of run-out table rolls, a mill crane or similar device having a crane hook 6 engages heavy-duty pin 4 of steel block 2, which is joined via pins (8, 10, 12) and steel cables (14, 16, 18) to support 20 and polishing block assembly 26. The crane, which may be roboticly driven, picks up the polishing assembly and moves it to a position above the last run-out table roll located proximate to the first downcoiler pinch roll frame (not shown) in the hot strip mill. The polishing block assembly 26 is preferably positioned in this manner before the hot strip mill shuts down for the ten- to twelve-minute work roll changing procedure.

At this time, the run-out table rolls are rotating at full speed (approximately 40 to 60 miles per hour). As soon as the last coil is made and the finishing stand area is shut down to change the work rolls, the mill crane lowers polishing block assembly 26 and its connected supporting structure so that polishing block assembly 26 contacts the last run-out table roll. Polishing block assembly 26 is then laid down upon the run-out table rolls, preferably such that at least 10 to 20 run-out table rolls are simultaneously contacted.

FIG. 15 illustrates that once the "blanket" of abrasive pads (28, 46) of polishing block assembly 26 is resting on top of a series of run-out table rolls 64, polishing block assembly 26 is slowly transported by the crane over the 300 to 500 run-out table rolls 64 toward the finishing stand area. As depicted by the arrows in FIG. 15, this direction of polishing apparatus transport is opposite to the direction of rotation of the run-out table rolls 64 (the direction of hot strip transport). As polishing block assembly 26 passes over the run-out table rolls 64, iron deposits are removed from the rolls by the action of contact surface portions (30, 32, 48, 50) of abrasive blocks (28, 46) against the rotating table rolls 64. Water is sprayed onto the table rolls from below during the polishing operation in order to facilitate removal of the iron deposits.

Run-out table rolls are sometimes configured to be vertically and laterally skewed. This arrangement assures that the hot strips travel along the center of the run-out table rolls. Further, to avoid misalignment of the run-out table rolls, steel companies sometimes employ table rolls that have a concave shape, which also forces the hot strips to travel along the center of the rolls. The loose assembly of abrasive blocks (28, 46) arranged in a flexible grid-like configuration assures that polishing block assembly 26 uniformly contacts the surface of table rolls having a concave contour or rolls that are vertically and laterally skewed.

Polishing block assembly 26 should be maintained in contact with table rolls 64 during transport from the last run-out table roll (proximate the first downcoiler pinch roll frame) to the first run-out table roll (proximate the finishing stand area). The crane preferably transports polishing block assembly 26 over run-out table rolls 64 in less than ten minutes, so that the table roll cleaning operation is terminated prior to completion of the work roll changing operation.

Once transport of polishing block assembly 26 over the surface of table rolls 64 has been completed, the crane should slowly raise the entire cleaning assembly, remove it from the area, and store the apparatus until another cleaning of the run-out table rolls is deemed necessary. The polishing process is preferably repeated each time the work rolls in the finishing stand are changed.

The roll polishing apparatus and method provided by the invention therefore eliminate the dangerous practice of hand-grinding run-out table rolls. In addition to this safety improvement, the invention has been found to significantly increase the productivity of hot strip mills by reducing mill shut-down time, yielding substantial cost savings for the steel industry, while also improving the overall quality of the hot-rolled coils produced.

The invention being thus described, it will be obvious that the same may be varied in many ways. Such variations are not to be regarded as a departure from the spirit and scope of the invention, and all such modifications are intended to be included within the scope of the following claims.

What is claimed is:

1. Apparatus for polishing run-out table rolls, comprising:

(a) a polishing block assembly comprising a plurality of linked abrasive blocks, wherein each of the abrasive blocks includes top and bottom contact surfaces made of a hard synthetic rubber having abrasive particles homogeneously embedded therein, each of the abrasive blocks further including a plate embedded through a middle portion of the abrasive block, the plate having a plurality of connecting holes located along outer edges of the plate to allow the plurality of abrasive blocks to be linked together; and (b) a support for joining an upper edge of the polishing block assembly to means for positioning the polishing block assembly over and into contact with a plurality of run-out table rolls.

2. The apparatus of claim 1, further comprising a plurality of linking plates located between adjacent abrasive blocks, the linking plates having a plurality of connecting holes which align with the plurality of connecting holes in the plates embedded through the abrasive blocks.

3. The apparatus of claim 2, further comprising rubber linkages joining the linking plates to the plates embedded through the abrasive blocks.

4. The apparatus of claim 1, wherein the plates embedded through the abrasive blocks include perforations which enhance bonding of the plates to the abrasive blocks.

5. The apparatus of claim 1, wherein each of the abrasive blocks includes a middle portion made of a softer rubber than the rubber used to form the top and bottom contact surfaces of the abrasive blocks.

6. An abrasive block for polishing run-out tables, the abrasive block comprising top and bottom contact surfaces made of a hard synthetic rubber having abrasive particles homogeneously embedded therein, a middle portion made of a rubber that is softer than the rubber used to form the top and bottom contact surfaces, and a plate embedded through the middle portion of the abrasive block, the plate having top and bottom portions extending outside of the abrasive block, the top and bottom portions of the plate having a plurality of connecting holes which allow the abrasive block to be linked to other abrasive blocks.

7. The abrasive block of claim 6, wherein the plate has perforations which enhance mechanical bonding of the plate to the abrasive block.

8. A method of polishing run-out table rolls, comprising:

(a) positioning a polishing block assembly over a plurality of run-out table rolls;

(b) lowering the polishing block assembly so as to contact the run-out table rolls;

(c) transporting the polishing block assembly in a linear direction along the plurality of run-out table rolls, while maintaining contact with the run-out table rolls, so as to polish a surface of the run-out table rolls; and (d) lifting the polishing block assembly off of the run-out table rolls.

9. The method of claim 8, wherein the operations recited in steps (a) through (d) are carried out by a crane.

10. The method of claim 8, wherein the operations recited in steps (a) through (d) are carried out by robotic means.

11. The method of claim 8, wherein plurality of run-out table rolls are aligned so as to have an end proximate to at least one downcoiler pinch roll and an opposite end proximate to at least one finishing stand, and the polishing block assembly is transported from the end proximate to the at least one downcoiler pinch roll to the end proximate to the at least one finishing stand.

12. The method of claim 8, wherein the polishing block assembly comprising a plurality of linked abrasive blocks.

13. The apparatus of claim 12, wherein each of the abrasive blocks is constructed of rubber, and the abrasive blocks include top and bottom contact surfaces made of a hard synthetic rubber having abrasive particles homogeneously embedded therein.

14. The apparatus of claim 12, wherein each of the abrasive blocks is constructed of rubber, and the abrasive blocks include a middle portion made of a softer rubber than the rubber used to form top and bottom contact surfaces of the abrasive block.

15. The apparatus of claim 12, wherein each of the abrasive blocks includes at least one plate embedded through a middle portion of the abrasive block.

16. The apparatus of claim 15, wherein the at least one plate includes perforations to enhance bonding of the plate to the abrasive blocks.

17. The apparatus of claim 16, wherein the at least one plate includes connecting holes located along outer edges of the plate.

18. The apparatus of claim 17, further comprising a plurality of linking plates located between adjacent abrasive blocks, the linking plates having a plurality of connecting holes which align with the plurality of connecting holes in the plates embedded through the abrasive blocks.

19. The apparatus of claim 18, further comprising rubber linkages joining the linking plates to the plates embedded through each abrasive block.

20. The method of claim 8, wherein steps (b) through (d) are carried out during the changing of a least one work roll of a finishing stand in a hot strip mill.

21. Apparatus for polishing run-out table rolls, comprising:

(a) a polishing block assembly comprising a plurality of linked abrasive blocks; and (b) a crane operatively engaged with said polishing block assembly, wherein said crane selectively positions said polishing block assembly over and into contact with a plurality of run-out table rolls.

22. Apparatus for polishing run-out table rolls, comprising:

(a) a polishing block assembly comprising a plurality of linked abrasive blocks; and (b) a robotically driven apparatus operatively engaged with said polishing block assembly, wherein said robotically driven device selectively positions said polishing block assembly over and into contact with a plurality of run-out table rolls.

23. Apparatus for polishing run-out table rolls, comprising:

(a) a polishing block assembly comprising a plurality of linked abrasive blocks;

(b) positioning apparatus operatively engaged with said polishing block assembly, wherein said positioning apparatus selectively positions said polishing block assembly over and into contact with a plurality of run-out table rolls;

(c) a support in connecting engagement with an upper edge of said polishing block assembly; and (d) a block in connecting engagement with said support and said positioning apparatus.

24. Apparatus for polishing run-out table rolls, comprising:

(a) a polishing block assembly comprising a plurality of linked abrasive blocks;

(b) positioning apparatus operatively engaged with said polishing block assembly, wherein said positioning apparatus selectively positions said polishing block assembly over and into contact with a plurality of run-out table rolls;

(c) a support in connecting engagement with an upper edge of said polishing block assembly; and (d) a plurality of cables linking a block in connecting engagement with said support and said positioning apparatus.

25. Apparatus for polishing run-out table rolls, comprising:

(a) a polishing block assembly comprising a plurality of linked abrasive blocks, each of said abrasive blocks including at least one plate embedded through a middle portion thereof; and (b) positioning apparatus operatively engaged with said polishing block assembly, wherein said positioning apparatus selectively positions said polishing block assembly over and into contact with a plurality of run-out table rolls.

26. Apparatus for polishing run-out table rolls, comprising:

(a) a polishing block assembly comprising a plurality of linked abrasive blocks, each of said abrasive blocks including at least one plate embedded through a middle portion thereof, each of said at least one plate including perforations to enhance bonding of said at least one plate to said abrasive blocks; and (b) positioning apparatus operatively engaged with said polishing block assembly, wherein said positioning apparatus selectively positions said polishing block assembly over and into contact with a plurality of run-out table rolls.

27. Apparatus for polishing run-out table rolls, comprising:

(a) a polishing block assembly comprising a plurality of linked abrasive blocks, each of said abrasive blocks including at least one plate embedded through a middle portion thereof, each of said at least one plate including connecting holes located along outer edges of said at least one plate; and (b) positioning apparatus operatively engaged with said polishing block assembly, wherein said positioning apparatus selectively positions said polishing block assembly over and into contact with a plurality of run-out table rolls.

28. Apparatus for polishing run-out table rolls, comprising:

(a) a polishing block assembly comprising a plurality of linked abrasive blocks, each of said abrasive blocks including at least one plate embedded through a middle portion thereof, each of said at least one plate including connecting holes located along outer edges of said at least one plate;

(b) a plurality of linking plates located between adjacent abrasive blocks, said linking plates having holes in alignment with said connecting holes; and (c) positioning apparatus operatively engaged with said polishing block assembly, wherein said positioning apparatus selectively positions said polishing block assembly over and into contact with a plurality of run-out table rolls.

29. Apparatus for polishing run-out table rolls, comprising:

(a) a polishing block assembly comprising a plurality of linked abrasive blocks, each of said abrasive blocks including at least one plate embedded through a middle portion thereof, each of said at least one plate including connecting holes located along outer edges of said at least one plate;

(b) a plurality of linking plates located between adjacent abrasive blocks, said linking plates having holes in alignment with said connecting holes;

(c) rubber linkages joining said holes to said connecting holes; and (d) positioning apparatus operatively engaged with said polishing block assembly, wherein said positioning apparatus selectively positions said polishing block assembly over and into contact with a plurality of run-out table rolls.

* * * * *